US005902029A

United States Patent [19]

Fulterer

[11] Patent Number: 5,902,029

[45] Date of Patent: May 11, 1999

[54] PULLOUT ASSEMBLY FOR A TALL CUPBOARD

[75] Inventor: Manfred Fulterer, Lustenau, Austria

[73] Assignee: Fulterer Gesellschaft m.b.H., Lustenau, Austria

[21] Appl. No.: 09/096,289

[22] Filed: Jun. 11, 1998

[30] Foreign Application Priority Data

Jun. 11, 1997 [AT] Austria ..... 1008/97
Jul. 16, 1997 [AT] Austria ..... 1207/97

[51] Int. Cl.[6] ..... A47B 88/00

[52] U.S. Cl. ..... 312/334.29; 312/334.39; 312/334.44

[58] Field of Search ..... 312/334.23, 334.24, 312/334.25, 334.26, 334.27, 334.28, 334.29, 334.31, 334.32, 334.33, 334.39, 334.41, 334.43, 334.44, 334.8, 334.9, 334.12, 334.15, 334.18; 384/19

*Primary Examiner*—Peter M. Cuomo
*Assistant Examiner*—Karlena D. Schwing
*Attorney, Agent, or Firm*—Anderson, Kill & Olick, P.C.

[57] ABSTRACT

A pullout assembly for a tall cupboard including U-shaped stationary, intermediate, and pullout rails, with the stationary and pullout rails being respectively attachable to a tall cupboard and a pullout section of the tall cupboard and with the three rails being arranged in a nested relationship relative to each other, and further including two stops for limiting a pullout length of the pullout rail with one stop being provided in the front region of the intermediate rail and projecting upward from the foot web of the intermediate rail, and another stop being provided on an underside of the foot web of the pullout rail, and with at least one of the two stops being releasably secured to a respective rail.

25 Claims, 5 Drawing Sheets

V
H
B

Fig. 7
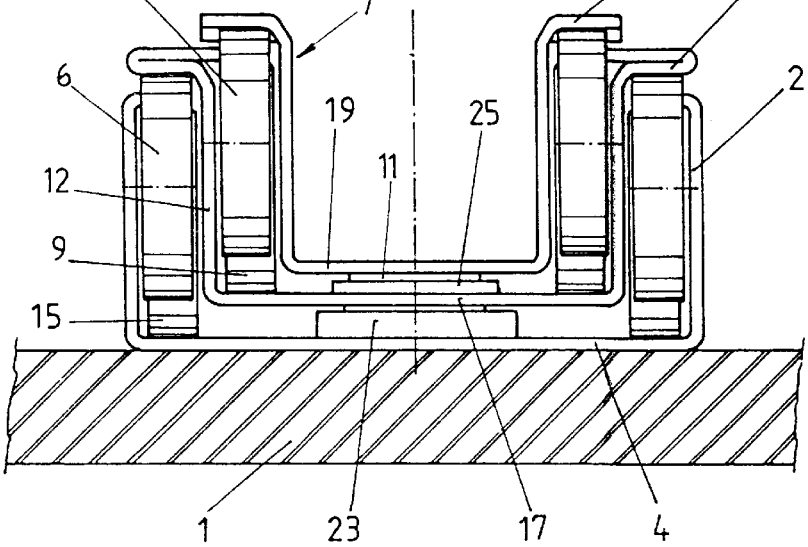
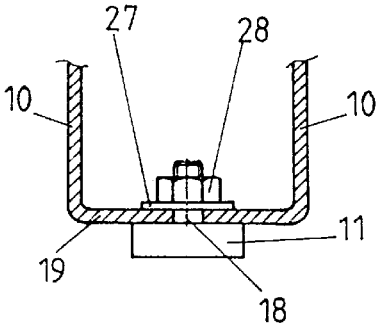
Fig. 9
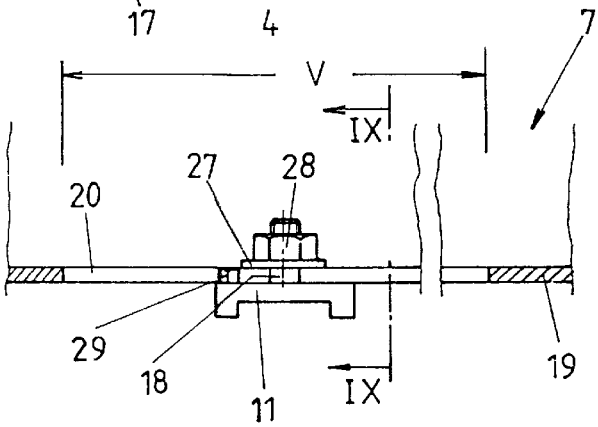
Fig. 8
Fig. 10
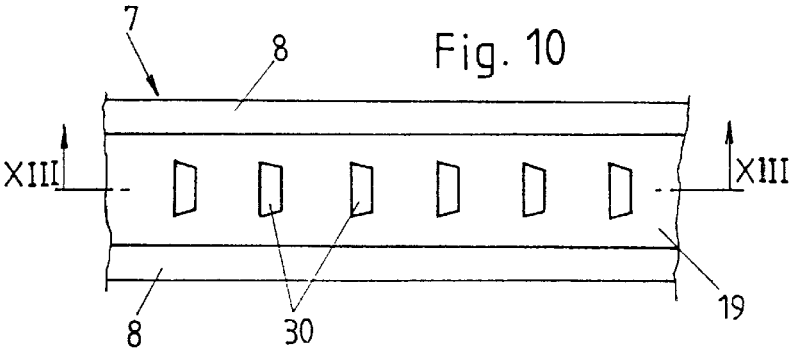
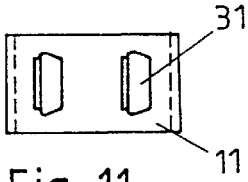
Fig. 11
Fig. 13
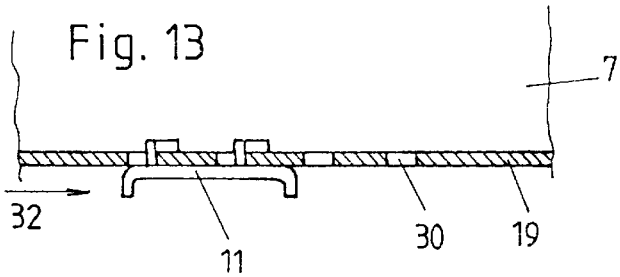
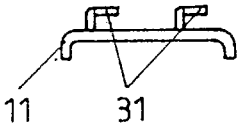
Fig. 12

Fig. 14
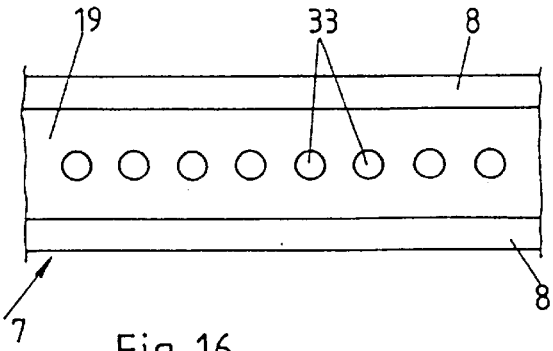
Fig. 15
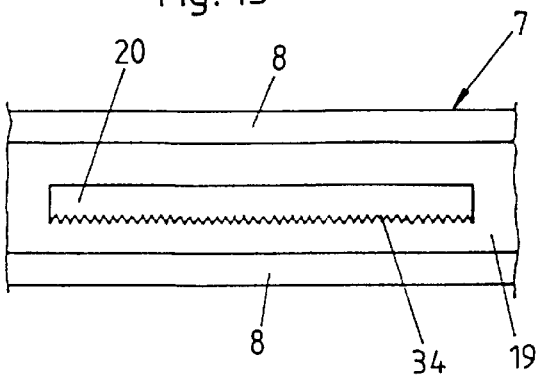
Fig. 16
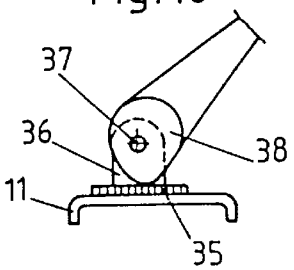
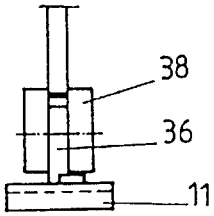
Fig. 17
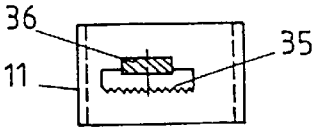
Fig. 18
Fig. 19
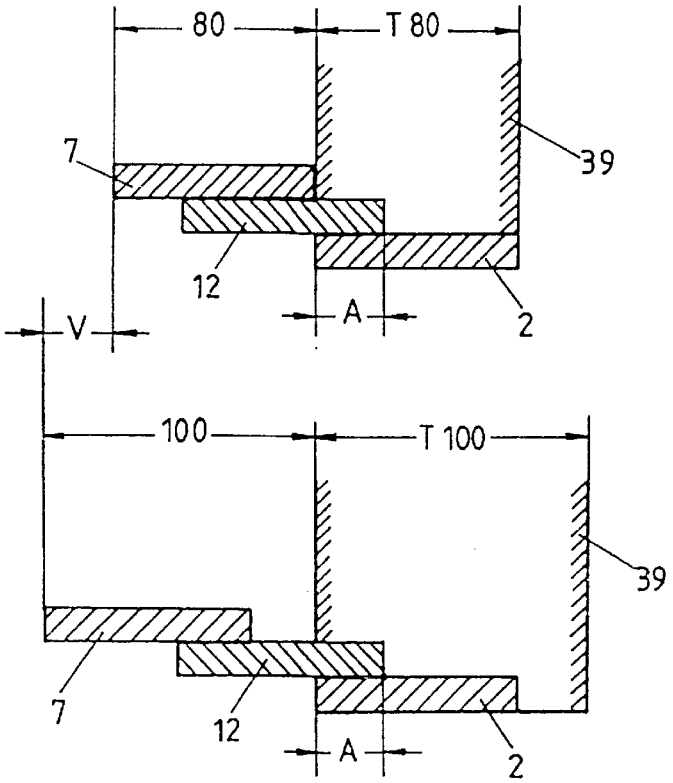

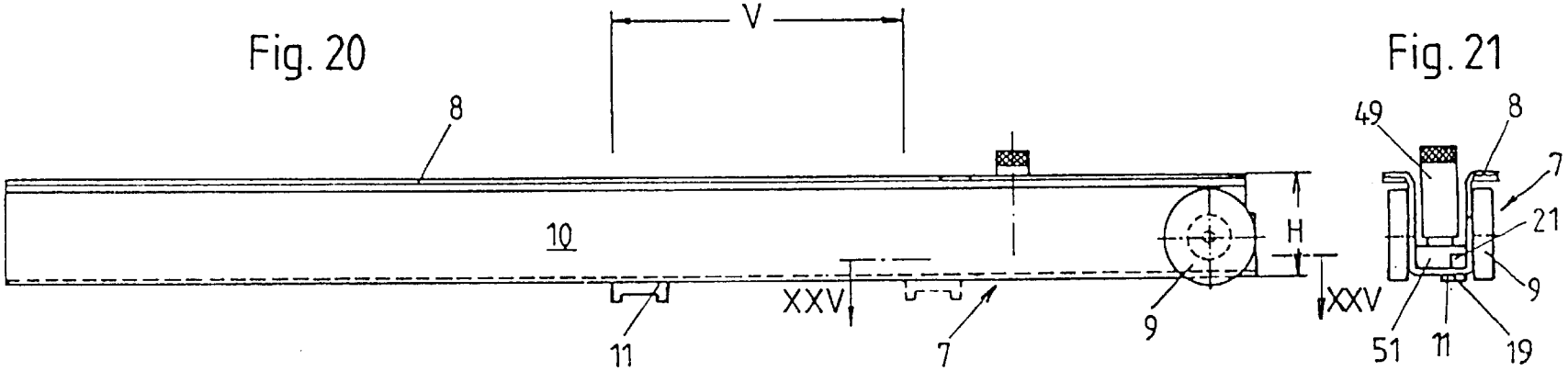
Fig. 21
Fig. 20
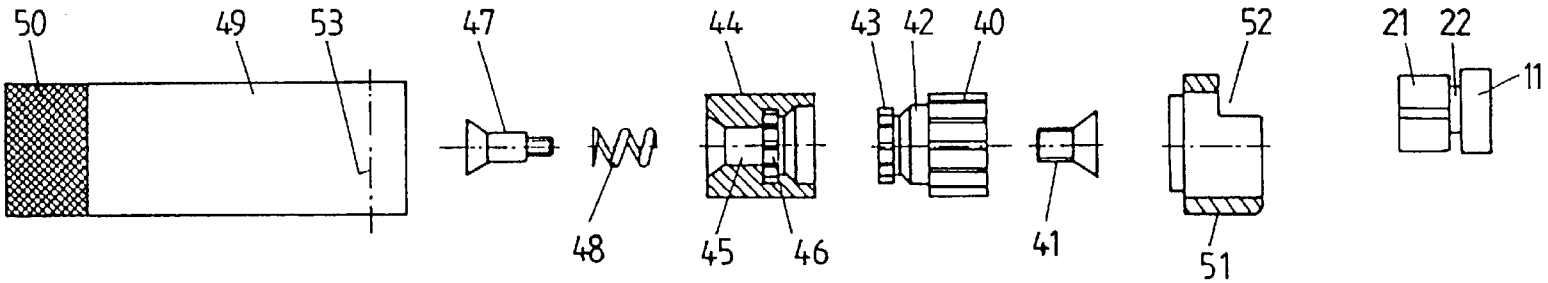
Fig. 24

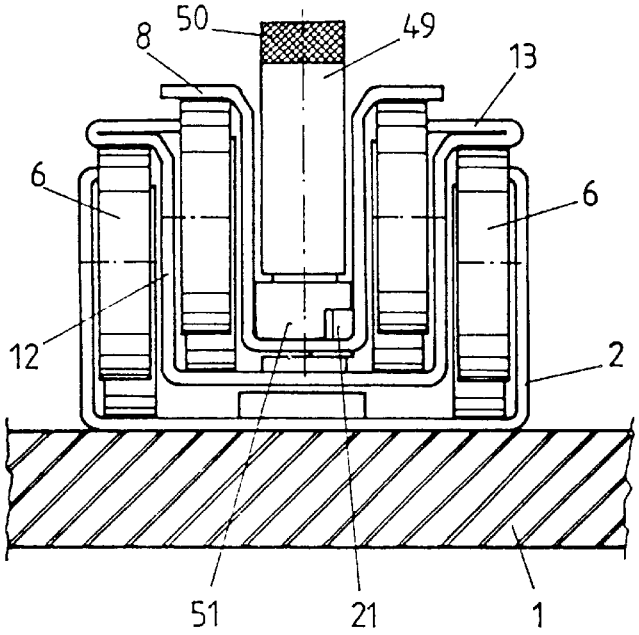
Fig. 22
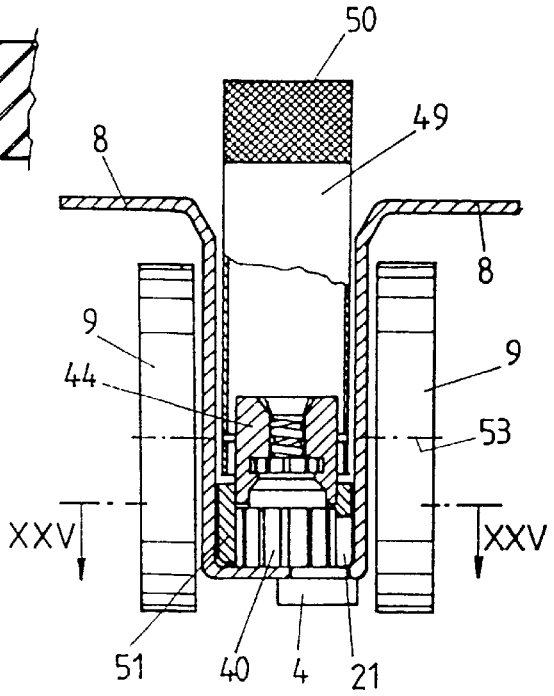
Fig. 23
Fig. 25
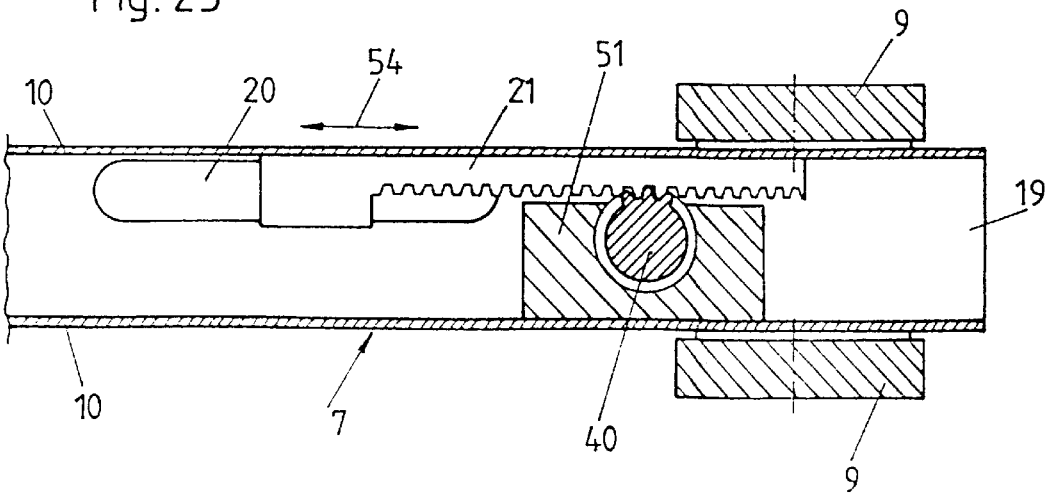

PULLOUT ASSEMBLY FOR A TALL CUPBOARD

BACKGROUND OF THE INVENTION

1. Field of the Invention

The present invention relates to a pullout assembly for a tall cupboard including a stationary U-shaped rail securable to a cupboard and having vertical side checks and support rollers which are provided in a region of an end side of the stationary rail and which project above the vertical side cheeks of the stationary rail, a pullout U-shaped rail telescopically arrange within the stationary rail in a nested relationship therewith and securable to an underside of a pullout section of the cupboard, the pullout rail being provided on its opposite outer sides in its rear region with running rollers which project downwardly beneath a foot web connecting opposite side cheeks of the pullout rail, and at least one intermediate U-shaped rail arranged between the stationary and pullout rails in a nested relationship therewith and having opposite cheeks provided at their upper edges with horizontal T-shaped flanges, the intermediate rail being provided in its front region with support rollers projecting vertically above the T-shaped flanges and in its rear region with running rollers projecting vertically beneath a foot web connecting the opposite cheeks of the pullout rail.

2. Description of the Prior Art

A pullout slide assembly of the type described above is disclosed in a prospect of a firm "Peka Metal AG" of February, 1996. In this assembly, the U-shaped pullout rail is so arranged that its open side faces downwardly and the side flanges are received between rollers of the central or intermediate rail. To take into the account different depths of the tall cupboards, several pullout slide assemblies with different lengths need be employed, with the pullout assemblies distinguishing from each other only by their length. As a rule, ten and more pullout slide assemblies of the same type but having a different length have been used, with a difference in length between two separate assemblies amounting to 50 mm. Thus, for a depth range from 400 to 1000 mm, ten or more pullout assemblies were required. The need for a large number of pullout slide assemblies led to a large expenditure of material and required a large storage space.

A rolling guide for such an assembly is disclosed in German publication DE 34 25 517A1. In the assembly disclosed in this German document, braking and/or stop means in a form of a braking member, which is secured on the inner rail, is used, which can be actuated even when the maximum displacement the inner rail with respect to the outer rail has not been effected. To this end, an elongate slot is provided in the inner rail and within which the braking member, which can be secured in a desired position, is arbitrary displaceable. The longitudinal displacement of the braking member permits to determine when the action of the braking member takes place with regard to the desired braking and an end position locking. For pullout assemblies for tall cupboards, this solution is neither applicable nor can it be transferred to the pullout slide assembly of the above-described type.

Accordingly, an object of the present invention is to provide a pullout slide assembly of the above-described type which would be capable of being used for a larger depth range while having a single predetermined length, so that it can be used for tall cupboards having different depths.

SUMMARY OF THE INVENTION

This and other objects of the present invention, which will become apparent hereinafter, are achieved by providing, in a pullout assembly described above, a stop at the front end of an intermediate rail and which extends upward from the foot web of the rail and by providing on the lower surface of the foot web of the pullout rail a stop a longitudinal position of which can be adjusted within a certain adjustment path and which cooperates with the stop provided at the front end of the intermediate rail.

BRIEF DESCRIPTION OF THE DRAWINGS

The features and objects of the present invention will become more apparent, and the invention itself will be best understood from the following detailed description of the preferred embodiments of the present invention when read with reference to the accompanying drawings, wherein:

FIG. 7 shows a front elevational view of the rails shown in FIGS. 1–6 in an assembled condition;

FIG. 8 shows a partial cross-sectional view along the pullout rail of pullout assembly according to the present invention;

FIG. 9 shows a cross-sectional view along line 1X—1X in FIG. 8;

FIG. 10 shows a plan view of another embodiment of the pullout rail of a pullout telescopic slide assembly according to the present invention;

FIG. 11 shows a plan view of the stop provided on the rail shown in FIG. 10;

FIG. 12 shows a side view of the stop shown in FIG. 11;

FIG. 13 shows a cross-sectional view along line XIII—XIII in FIG. 10;

FIG. 14 shows a plan view of yet another embodiment of the pullout rail of a pullout telescopic slide assembly according to the present invention;

FIG. 15 shows a further embodiment of the pullout rail of a pullout telescopic slide assembly according to the present invention;

FIG. 16 shows a side view of the stop provided on the rail shown in FIG. 15;

FIG. 17 shows a front elevational view of the stop of FIG. 16;

FIG. 18 shows a plan view of the stop shown in FIGS. 16–17;

FIG. 19 shows a schematic view illustrating the effect of the present invention;

FIG. 20 shows a side view of an extendable rail with a different adjusting device for a stop;

FIG. 21 shows a front elevational view of the rail show in FIG. 20;

FIG. 22 shows a front elevational view of the rails shown in FIGS. 1, 2, 5, 6 and 20, 21 in an assembled condition;

FIG. 23 shows a view similar to that of FIG. 21 but an increased scale and partially in cross-section;

FIG. 24 shows an exploded view of elements used for an adjustment of a tooth rack; and FIG. 25 shows a horizontal cross-sectional view along line XXV—XXV in FIG. 23.

DETAILED DESCRIPTION OF THE PREFERRED EMBODIMENT

Figures 1, 2, 3, 4, 5, 6:
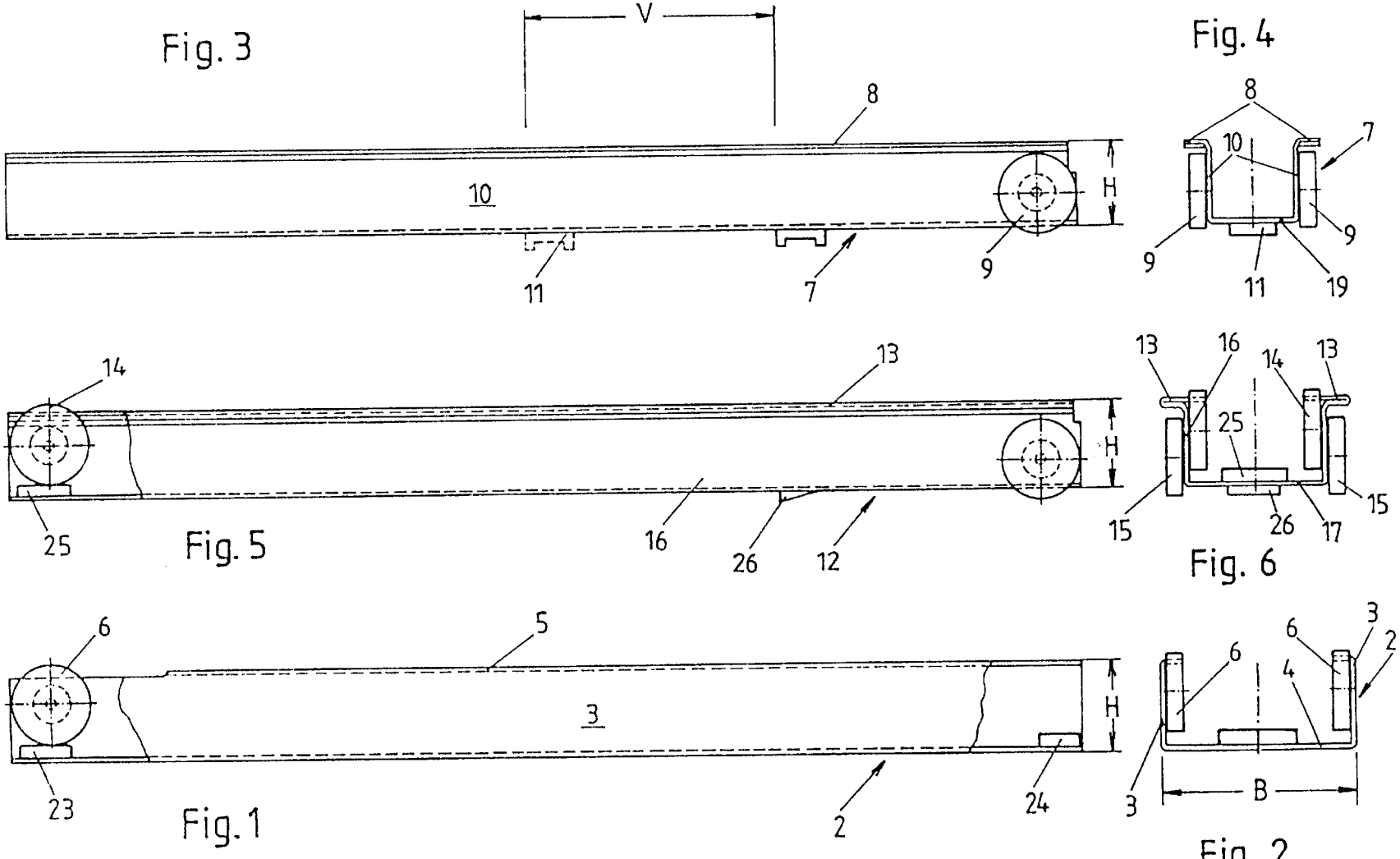
FIG. 1 shows a side view of a stationary rail of a pullout telescopic slide assembly for a tall cupboard according to the present invention.
FIG. 2 shows a front elevational view of the rail shown in FIG. 1.
FIG. 3 shows a side view of a pullout rail of a telescopic slide assembly for a tall cupboard according to the present invention.
FIG. 4 shows a front elevational view of the rail shown in FIG. 3.
FIG. 5 shows a side view of an intermediate rail of a pullout telescopic slide assembly for a tall cupboard according to the present invention.
FIG. 6 shows a front elevational view of the rail shown in FIG. 5.

A stationary rail 2 of a telescopic slide assembly according to the present invention, which is secured to a furniture member 1, has a U-shaped cross-section with two side cheeks 3 and a foot web 4 connecting the two side cheeks 3. Upper edges of the side cheeks 3 are bent inwardly toward the middle plane of the rail 2, forming horizontal flanges 5. At the front end of the rail 2, the flanges 5 have a cut-out, and freely rotable support rollers 6 are located in the cut-outs of the horizontal flanges 5. The support rollers 6, as shown in FIGS. 1–2, project somewhat above the horizontal flanges 5. The support rollers 6, as shown, are provided on the inner side of the side cheeks 3. When a reference to a plurality of rollers is made, here and elsewhere, it means that in the cross-sectional plane of a rail a pair of rollers 6 is provided. In this case, as shown in FIG. 2, two rollers 6, arranged one after another, extend at a right angle to the drawing plane seen in FIG. 1. Two end stops 23 and 24 are provided on the foot web 4 of the rail 2. The stops 23 and 24 limit the extendable movement of an intermediate rail 12 which will be described in detail below.

The rail 7, which has a U-shaped cross-section and serves as a pull-out rail, is secured on a pullout section of the cupboard or on a pullout frame. The rail 7 has T-shaped flanges 13 which extend both inward and outward. In the rear region of the rail 7, there are provided freely rotatable running rollers 9. The rollers 9 are supported on outer sides of side cheeks 10. A stop 11 is provided on the lower surface of a foot web 19 which connects the two side cheeks 10. The stop 11 is displaceable in a longitudinal direction within a region V of the rail 7 and is securable in its desired longitudinal position. The end positions of the stop 11 are shown with solid and dash lines in FIG. 3. The stop 11 serves for limiting the pullout movement of the pullout rail 7. The U-shaped rail 7 is secured on the bottom of the pullout tall cupboard section or of the pullout frame.

The intermediate rail 12 also has a U-shaped profile and has, at the upper edges of its cheeks 16, T-shaped horizontal flanges 13, having portions directed outwardly and portions directed inwardly. At the front region, the intermediate rial 12 is provided with a pair of support rollers 14 which are mounted on inner sides of respective cheeks 16 of the rail 12. The support rollers 14, as shown in FIGS. 5–6, project somewhat above the T-shaped horizontal flanges 13. In the rear region of the intermediate rail 12, there are provided running rollers 15 which are mounted on outer sides of the side cheeks 16. The running rollers 15, as shown in the drawings, project somewhat below the foot web 17 of the intermediate rail 12. The intermediate rail 12 has a front stop 25. A rear stop 26 is provided at the rear end of the intermediate rail 12 and is secured on the lower surface of the foot web 17. The longitudinally adjustable stop 11 provided on the lower surface of the foot web 19 of the pullout rail 7 and the front stop 25 provided in the front region of the intermediate rail 12 cooperate with each other, limiting the extension length of the pullout rail 7 with respect to the intermediate rail 12.

All of the rails 2, 7 and 12 have approximately the same height H, the diameter of the support and running rollers can also be the same. However, the widths B of the rails 2, 7 and 12 are different, and are so selected that the rails 2, 7, 12 are telescopically arranged within each other, as can be seen in FIGS. 7 and 9. The open sides of all of the rails 2, 7, 12 are directed upwardly, and the foot webs 4, 21, 19 of the rails 2, 7, and 12 are arranged adjacent to each other one above another, with a small distance therebetween. The vertical distances between two adjacent foot webs are substantially the same and amount to about 2/10 of the height H.

The slide assembly, as shown in FIG. 7, is a telescopical assembly. In the open space of the uppermost, extendable rail 7, a carrier frame 20 of a tall cupboard can be mounted. The frame 20 is circumferentially closed and is formed of sectional frames. Carriers baskets 22 can be suspended directly on vertical sections of the carrier frame 20. Alternatively, the vertical sections of the frame 20 can support elements of a tall cupboard.

The stop 11 is formed as a plate-shaped member, and its front and rear, in the pullout direction of the slide assembly, edge portions are flanged downwardly to insure a better stability. In a first embodiment (FIGS. 8 and 9), a bolt 18 is provided on the upper surface of the stop 11. The bolt 18 projects through an elongate slot 20 formed in the foot web 19 of the pullout rail 7.

The elongate slot 20 extends along the stop adjustment region V. FIG. 8 shows a partial cross-sectional view along the rail 7, and FIG. 9 shows a cross-sectional view along line IX—IX in FIG. 8. For fixing the stop 11 in a predetermined position along the elongate slot 20, preferably, a guide pin 29 is provided on the upper surface of the stop 11. The pin 29 has a length that does not exceed the thickness of the foot web 19. The pin 29 provides for a stepless adjustment of the stop 11 along the region V. To position the stop 11, the nut 28 is released, and the stop 11 is displaced, along the slot 20, a predetermined amount. Then, the nut 28 is tightened again. The pin 29 insures proper positioning of the stop 11 with respect to the elongate slot 20.

FIG. 10 shows a plan view of another embodiment of the pullout rail 7. In this embodiment, a plurality of trapezoidal punched-out openings 30 equidistantly spaced from each other are provided in the region V of the pullout rail 7. The stop 11, a plan view of which is shown in FIG. 11 and a side view of which is shown in FIG. 12, is provided on its upper surface with hook-like brackets 31 spaced from each other by a distance corresponding to the distance between the punched-out openings 30. The brackets 31 are inserted from beneath of the foot web 19 through the openings 30, and then the stop 11 is displaced and occupies a position shown in FIG. 13 representing a longitudinal cross-sectional view along line XIII—XIII in FIG. 10. At that, the hook-liked brackets 31 and the thickness of the foot web 19 are so adapted to each other that the brackets 31 clampingly secure the stop 11 to the foot web 19 of the rail 7. The brackets 31 face in the insertion direction of the slide assembly so that upon insertion, the stop 11 is always stressed only in the direction of arrow 32 until it bumps into the stop 25 of the intermediate rail 12.

The stop 11, which is shown in FIGS. 8–9, can also be used with the pullout rail 7 formed as shown in FIG. 14 showing a plan view of the rail 7. Here, a row of holes 33 is formed in the adjustment region V which are spaced from each other by distance corresponding to the distance between the bolt 18 and the guide pin 29.

Yet another embodiment of the pull-out rail 7 is shown in FIG. 15 which shows a plan view of the rail 7. In this embodiment of the rail 7, as in the embodiment of FIGS.

8–9, an elongate slot 20 is provided in the stop adjustment region V. The difference between the two embodiments consists in that in the embodiment of FIG. 15, the slot 20 has a toothed longitudinal edge 34. The stop 11, side, front and plan, with a toggle lever being removed, views of which are shown in FIGS. 16–18, carriers on its upper surface a toothed strip 35 which engages the toothed longitudinal edge 34 of the slot 20 upon insertion of the stop 11. Sidewise of the toothed strip, a bearing block 36 is provided. The block 31 supports a toggle lever 38 which pivot about an axle 37. The toggle lever 38 has, as shown in FIG. 17 a fork-like shape. The pivot stroke of the lever 38 is somewhat bigger than the thickness of the foot web 19. Thus, when the toggle lever 38 is in its open position, the stop 11 can be disengage from the toothed edge 34 and displaced downward. Then, the longitudinal position of the stop 11 along the slot 20 can be adjusted. The toggle lever 38 is preferably supported for pivotal movement in the central plane of the rail 7. The pivot axle 37 of the toggle lever 38 is preferably displaceable in its longitudinal direction. A plurality of congruent openings is formed in the side cheeks 10 of the rail 7 in the stop adjustment region V. The stop 11 is so displaced in the region V in such a way that the axle 37 coincides with these openings. The axle 37 can be pushed out with a pin or, during mounting of the stop 11, be inserted laterally.

FIG. 19 shows a schematic view illustrating effect achieved by the present invention. The upper portion of FIG. 19 shows a tall cupboard having a depth of 80 mm. The pullout slide assembly has a nominal length of 80 mm and is schematically illustrated by three hatched beams overlying each other the three beams are assigned with the respective reference numerals indicating respective rails. A stop defines a completely pullout front position of the pullout rail 7. The distance "A" is defined by the stationary stops 23 and 26 on rails 2 and 12. The end side of the pullout rail 7 is spaced from the front wall of the cupboard by a distance which corresponds to the depth of the cupboard. The lower portion of FIG. 19 shows that with the arrangement according to the present invention, the distance between the front end surface of the pullout rail 7 and the front wall of the cupboard is 100 mm, which again corresponds to the depth of the cupboard 100 mm. The difference in the pullout distance of 20 mm is achieved by the backward displacement of the stop 11 by 20 mm, the length of the stop adjustment region V. Providing a longitudinally adjustable stop permitted to use the same pullout assembly for cupboards having different length.

The stop 11, position of which can be adjusted in the region V, cooperates with a stop 25 provided on the intermediate rail 12. A further adjustment of the pullout length can be achieved by making the stop 25 of the intermediate rail 12 likewise longitudinally adjustable. This permits to provide very narrow limits of the pullout in a restricted space.

Further embodiments of the present invention are shown in FIGS. 20–25. In all of the embodiments of FIGS. 20–25, the same three rails 2, 7, 12 are used, however, the longitudinal adjustment of the stop 11 is achieved with different means.

In order to adjust the longitudinal position of the stop 11 on the rail 7, the stop is connected to an end of a toothed rack 21, with connection element 22 projecting through the longitudinal slot 20 of the foot web 19 of the pullout rail 7. The toothed rack 21 lies on the foot web 19 and extends in a longitudinal direction of the rail 7. The toothed rack 21 cooperates with a pin on 40 supported on a bolt of screw 41 secured in the foot web 19. The bolt or screw 41 serves as a rotational axis. The pinion 40 has an upper shoulder 42 which passes into a toothed wheel 43 having an outer diameter smaller than the outer diameter of the pinion 40. The upper should 42 of the pinion 40 is encompassed by a coupling member 44 having a central bore 45 and an inner toothing 46 corresponding to the outer toothing of the toothed wheel 43. In the locked position of the coupling member 44, the inner toothing 46 of the coupling member 44 is engaged by the toothing of the toothed wheel 44.

A bolt or screw 47 connects the coupling member 44 with the pinion 40 with an axial backlash. The bolt 47 extends through a helical spring 48 which is received in the bore 45 of the coupling member 44. The spring 48 is support at its opposite ends on the head of the bolt 47 and against the pinion 40, respectively. The coupling member is received within a tubular operating handle 49 with a knurled upper region 50. The pinion 40 is received in a bearing member 51 which is attached to one of the side cheeks 40 of the rail 7 and has a section 52 which surrounds the toothed rack 21.

The axial length of the operating handle 49 is so selected that in its operating position (FIGS. 21 and 23), the handle 49 projects above the rail 7, making its knurled region 50 readily accessible when the longitudinal adjustment of the stop 11 is required. In its non-operating position, the operating handle 49 is retracted into the rail 7, being pivoted about its transverse axle 53 into a position in which it extends at a right angle to the plane of the drawing of FIG. 23.

FIG. 23 shows an operating position of the handle 49 when the stop 11 is displaceable along the adjustment path V. When in its operating position, the handle 49 is rotated about its longitudinal axis, its rotational movement is transmitted by the coupling member 44 to the pinion 40 which displaces the toothed rack 21 axially in directions indicated by a double arrow 54 (FIG. 25). Thereby, the stop 11, which is fixedly connected with or forms a part of the toothed rack 21, can be arbitrarily displaced into a desired position within the adjustment path V. The operating handle 49 can be pivoted into its substantially horizontal, non-operating position only when its transverse axle 53 extends perpendicular to the longitudinal extent of the pullout rail 7. When upon the rotation of the operating handle 49, the stop 11 is brought in a position in which the transverse axle 53 of the handle 49 does not extend perpendicular to the longitudinal extent of the rail 7, then upon release of the handle 49, the biasing force of the spring 48 lifts somewhat the uprightly extending handle 49, whereby the inner toothing 46 and the toothed wheel 43 of the pinion 43 become disengaged. Only then the operating handle 49 can be rotated about its longitudinal axis without changing the rotational position of the pinion 40. In the disengaged position of the inner toothing 46 and the toothed wheel 43, the operating handle 49 can be pivoted into a position in which the pivot axle 53 extends perpendicular to the longitudinal extent of the pullout rail 7 and be brought into its nonoperating position by being pivoted downwardly from the position shown in FIG. 23.

It is also possible to eliminate both the operating handle 49 and the coupling member 44 and instead, to provide a slot on the pinion 40 engageable by a tool, e.g., a screw driver. In this case during mounting of the pullout slide assembly, the pinion 40 can be rotated with the screwdriver until the stop 11 arrives at its desired position. In this case, means for preventing and accidental rotation of the pinion 40 also need be provided to prevent an unintended displacement of the stop 11. The anti-rotational means can be provided either on the pinion itself or on the toothed rack. When the operating handle 49, together with the coupling member 44, are used, the unintended rotation is prevented by the handle 49 itself.

The present invention permits to provide the same pullout range with four nominal lengths of the pullout assembly as with previously used thirteen pullout assemblies of the same type.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A pullout assembly for a tall cupboard, comprising:

a stationary U-shaped rail securable to a cupboard and having vertical side checks and support rollers which are provided in a region of an end side of the stationary rail and which project above the vertical side cheeks of the stationary rail;

a pullout U-shaped rail telescopically arrange within the stationary rail in a nested relationship therewith and securable to an underside of a pullout section of the cupboard, the pullout rail being provided on opposite outer side thereof in a rear region thereof with running rollers which project downwardly beneath a foot web connecting opposite side cheeks of the pullout rail;

at least one intermediate U-shaped rail arranged between the stationary and pullout rails in a nested relationship therewith and having opposite cheeks provided at upper edge thereof with horizontal T-shaped flanges, the intermediate rail being provided in a front region thereof with support rollers projecting vertically above the T-shaped flanges, and in a rear region thereof with running rollers projecting vertically beneath a foot web connecting the opposite cheeks of the pullout rail; and stop means for limiting a pullout length of the pullout rail, the stop means comprising a first stop provided in the front region of the intermediate rail and projecting upward from the foot web of the intermediate rail, and a second stop provided on an underside of the foot web of the pullout rail, at least one of the first and second stops being releasably secured to a respective rail for enabling a longitudinal displacement of the at least one of the first and second stops along the respective rail, with the pullout length of the pullout rail being determined by an adjustable position of the least one of the first and second stops on the respective rail.

2. A pullout device as set forth in claim 1, wherein the at least one of the first and second stops is the second stop which is provided in a rear half of the pullout rail.

3. A pullout device as set forth in claim 2, wherein the second stop is plate-shaped.

4. A pullout assembly as set forth in claim 3, wherein the plate-shaped second stop has opposite downwardly flanged edge portions.

5. A pullout assembly as set forth in claim 2, wherein the second stop has, on an upper surface thereof, a bolt cooperating with a nut for securing the stop on the pullout rail.

6. A pullout assembly as set forth in claim 5, wherein the second stop has a guide pin extending parallel to the bolt.

7. A pullout assembly as set forth in claim 6, wherein the foot web of the pullout rail has a slot extending along a length of the pullout rail over which the second stop is displaceable.

8. A pullout assembly as set forth in claim 6, wherein the foot web of the pullout rail has a row of openings extending along a length of the pullout rail over which the second stop is displaceable and wherein the openings are spaced from each other by a distance corresponding to the distance between the bolt and the guide pin.

9. A pullout assembly as set forth in claim 6, wherein the foot web of the pullout rail has a row of punched-out openings extending along a length of the pullout rail over which the second stop is displaceable, and wherein the second stop has on an upper surface thereof at least two hook-like brackets spaced from each other by a distance corresponding to a distance between adjacent punch-out openings, the hook-like brackets extending through the punch-out opening, form-lockingly engaging side walls of respective punched out openings.

10. A pullout assembly as set forth in claim 7, one of the longitudinal edge of the slot is provided with toothing, and the second stop has a toothed strip cooperating with the edge toothing.

11. A pullout assembly as set forth in claim 2, wherein the second stop is provided with a toggle lever pivotable in a vertical longitudinal central plane of the pullout rail and supported on a block securable to the second stop and extending through an elongate slot formed in the foot web of the pullout rail.

12. A pullout assembly as set forth in claim 2, wherein the second stop is connected with a tooth rack located inside of the pullout rail and which cooperates with a pinion for displacing the second stop.

13. A pullout assembly as set forth in claim 12, further comprising an operating handle for rotating the pinion.

14. A pullout assembly as set forth in claim 13, wherein the operating handle in an operating position thereof projects above the pullout rail.

15. A pullout assembly as set forth in claim 13, wherein the operating handle in a non-operating position thereof extends substantially parallel to a longitudinal extent of the pullout rail.

16. A pullout assembly as set forth in claim 13, wherein the operating handle is associated with a coupling member which is spring-biased into an engagement with the pinion.

17. A pullout assembly as set forth in claim 16, wherein the pinion is associated with toothed wheel engageable with an inner toothing provided in the coupling member.

18. A pullout assembly as set forth in claim 17, wherein the coupling becomes connected with the pinion upon axial displacement of a bolt extending through a helical spring supported at its opposite ends against a bolt head and the pinion, respectively.

19. A pullout assembly as set forth in claim 12, further comprising a threaded member extending through the foot web of the pullout rail for supporting the pinion.

20. A pullout assembly as set forth in claim 12, wherein the toothed rack extends through a bearing member surrounding, at least partially, the pinion.

21. A pullout assembly as set forth in claim 13, wherein the operating handle is formed as a tubular member.

22. A pullout assembly as set forth in claim 12, wherein one end of the toothed rack is connected with the second stop.

23. A pullout assembly as set forth in claim 12, wherein the foot web of the pullout rail has an elongate slot extending in a longitudinal direction of the rail over a length of a displacement path of the second stop, and wherein the second stop is located beneath and the toothed rack is located above the foot web.

24. A pullout assembly as set forth in claim 17, wherein the pinion has a diameter larger than a diameter of the toothed wheel associated with the pinion.

25. A pullout assembly as set forth in claim 12, wherein the pinion has a groove on an upper surface thereof engageable with a manual tool.

* * * * *